US005199615A

United States Patent [19]

Downing et al.

[11] Patent Number: 5,199,615

[45] Date of Patent: Apr. 6, 1993

[54] DISPENSER WITH PRESSURE RELEASE MECHANISM

[75] Inventors: Trevor Downing, Romford; Roderick M. Parker, Beccles, both of United Kingdom

[73] Assignee: Lawson Mardon Group UK Limited, London, United Kingdom

[21] Appl. No.: 936,080

[22] Filed: Aug. 28, 1992

Related U.S. Application Data

[63] Continuation of Ser. No. 689,249, filed as PCT/GB88/01103, Dec. 14, 1988, published as WO 90/06889, Jun. 28, 1990, abandoned.

[30] Foreign Application Priority Data

Jun. 11, 1987 [GB] United Kingdom ..... 8713636

[51] Int. Cl.[5] ..... B65D 83/70

[52] U.S. Cl. ..... 222/397; 222/402.1; 137/852

[58] Field of Search ..... 222/396, 397, 402.1; 137/852

[56] References Cited

U.S. PATENT DOCUMENTS

| | | | |
|---|---|---|---|
| 3,064,673 | 11/1962 | Rockwell | 222/396 X |
| 3,299,960 | 1/1967 | Stern | 222/396 X |
| 3,850,339 | 11/1974 | Kinkel | 222/397 X |
| 3,912,130 | 10/1975 | Pelton | 222/396 |
| 3,918,611 | 11/1975 | Ewald | 222/396 |
| 4,175,678 | 11/1979 | Fukuda | 222/396 X |
| 4,887,743 | 12/1989 | Blake | 222/402.1 |
| 4,993,602 | 2/1991 | Casey | 222/396 |

FOREIGN PATENT DOCUMENTS

| | | |
|---|---|---|
| 2284535 | 4/1976 | France . |
| 1499158 | 1/1978 | United Kingdom . |
| 2205614 | 12/1988 | United Kingdom . |

*Primary Examiner*—Gregory L. Huson
*Attorney, Agent, or Firm*—Larson and Taylor

[57] ABSTRACT

There is disclosed an aerosol dispenser (1) comprising a plastics container (2) and a closure which is secured in a fluid tight manner to a neck portion (4) of the container (2). The neck portion has a conformation such that, on deformation thereof by internal pressure at an elevated temperature, the seal between the closure and the container (2) is broken to permit the pressure in the dispenser to be released, while retaining the closure captive on the neck portion (4). Also disclosed is a plastics aerosol container (2) for use in the aerosol dispenser of the present invention.

9 Claims, 3 Drawing Sheets

DISPENSER WITH PRESSURE RELEASE MECHANISM

This application is a continuation of application Ser. No. 07/689,249 filed as PCT/GB88/01103, Dec. 14, 1988, published as WO 90/06889, Jun. 28, 1990, and now abandoned.

FIELD OF THE INVENTION

This invention relates to a dispenser and is more particularly, but not exclusively, concerned with a plastics aerosol dispenser having a fail-safe mechanism whereby, when the dispenser is subjected to an abnormal elevated temperature, pressure in the dispenser is released while retaining the closure of the dispenser captive.

BACKGROUND OF THE INVENTION

As used herein, the term "dispenser" means a dispensing container having a closure which may or may not include a valve, and "container" means a container at the end of the manufacturing operations carried out by the container maker.

We have recently found that a satisfactory container for an aerosol dispenser may be manufactured from various plastics materials such as polyethyleneterephthalate (PET) homopolymers or PET copolymers. Such aerosol dispensers perform well at room temperature and, by proper design and manufacture, meet the industry standard safety requirements. In particular, such dispensers are able to withstand immersion in a water bath, at an elevated temperature which raises the contents of the dispenser to the equilibrium pressure at 50° C., without noticeable distortion. In normal use, such dispensers are entirely safe, even in very hot climates. However, in conditions of abuse, performance is limited by failure of the dispenser at temperatures in the region of about 70° C. At this temperature, the plastics material of the container softens and, in combination with the elevated pressure of the contents, results in distortion of the neck region of the container and slackening of the dispenser closure. Eventually, the dispenser fails catastrophically, with the closure being forcibly ejected from the container.

SUMMARY OF THE INVENTION

According to the present invention, there is provided a dispenser comprising a plastics container and a closure which is secured in a fluid tight manner to a neck portion of the container, the neck portion being conformed such that, on deformation of the neck portion by internal pressure at an elevated temperature, the seal between the closure and the container is broken to permit the pressure in the dispenser to be released, while retaining the closure captive on the neck portion.

At elevated temperatures, dispensers in accordance with the present invention fail in a safe, controlled manner, by allowing escape of internal pressure without releasing the closure from the container.

Another aspect of the present invention provides a plastics container for use in a dispenser as described above.

BRIEF DESCRIPTION OF THE DRAWINGS

For a better understanding of the present invention, and to show how it may be carried into effect, reference will not be made, by way of example, to the accompanying drawings, in which.

DETAILED DESCRIPTION OF THE PREFERRED EMBODIMENTS

Figure 1A:
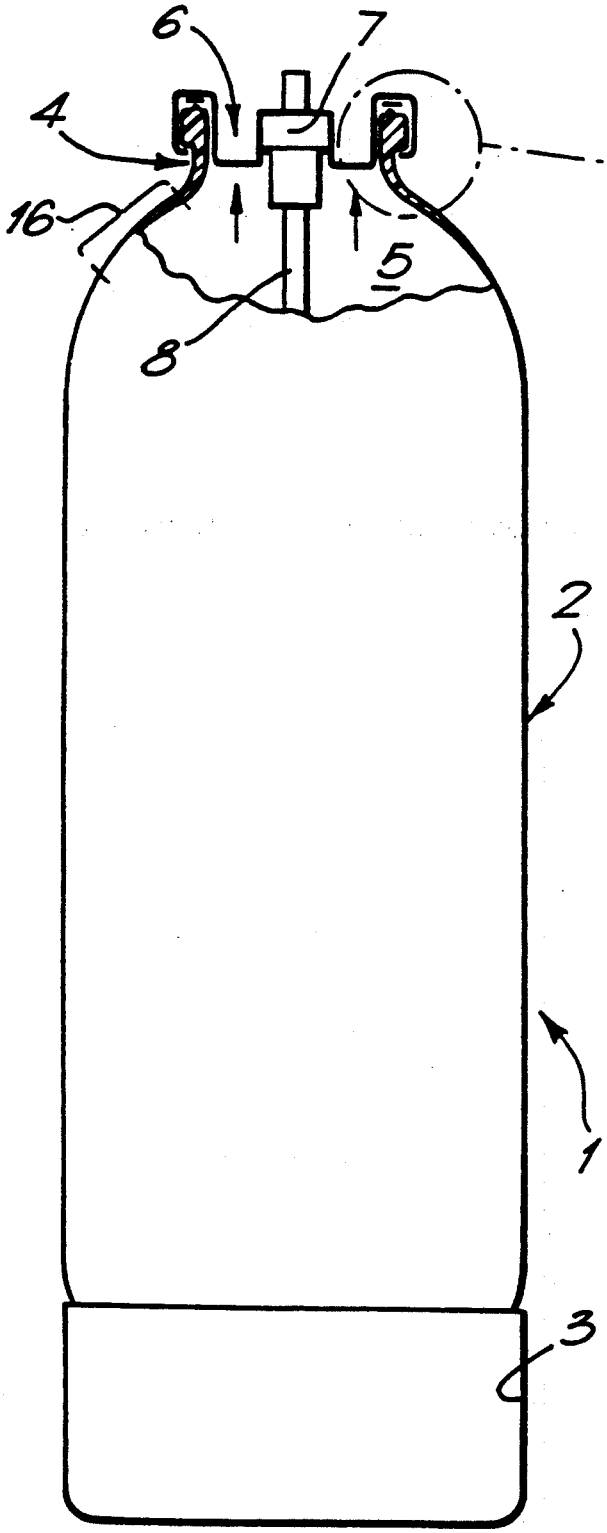
FIG. 1A is a partially sectioned side view of an aerosol dispenser of known form.
Figure 1B:
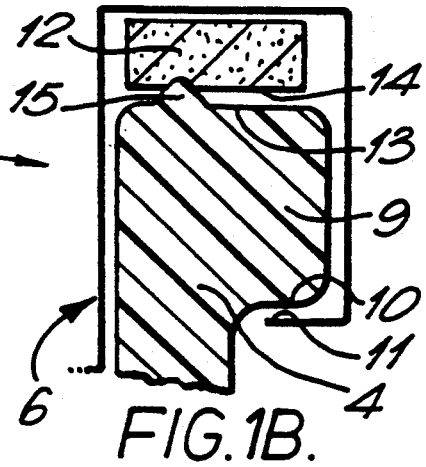
FIG. 1B is a sectional view, on an enlarged scale, of part of the dispenser of FIG. 1A.

With reference to FIGS. 1A and 1B, the known aerosol dispenser 1 comprises a plastics container 2 usually made from a PET homopolymer or PET copolymer. The container 2 is secured in a shallow, cup like base 3 which enables the container to be free-standing, it being appreciated that the container 2 itself, which is normally blow moulded, will have a rounded bottom. The container 2 is provided with a neck portion 4 defining a generally circular opening 5 to the container 2. The opening 5 is sealed in a fluid tight manner by a closure 6. The closure 6 includes a valve assembly 7 communicating with a dip-tube 8 which extends to the bottom of the container 2. Apart from the valve assembly 7, the closure 6 is made from a thin rigid metal which is crimped around the neck portion 4 of the container. Referring particularly to FIG. 1B, the neck portion 4 is enlarged relative to the wall of the container, thereby defining an integral annular projecting rim 9 which has a downwardly facing shoulder 10. The neck portion 4 may be viewed as comprising an annular continuation of the container wall and the rim 9. A crimped return 11 provided on the metal closure 6 engages the shoulder 10 of the rim 9. Also enclosed in the closure 6 is a seal 12 made of a deformable, impervious material. The neck portion 4 has an upper surface 13 which mates with the lower surface 14 of the seal 12 to provide a fluid-tight seal. Sealing may be enhanced by the provision of an annular sealing projection 15. More than one such projection may be provided.

Figure 1C:
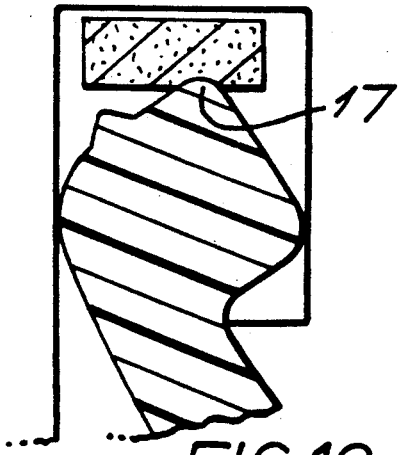
FIGS. 1C to 1E shown different stages during the failure of the dispenser of FIG. 1A.
Figure 1D:
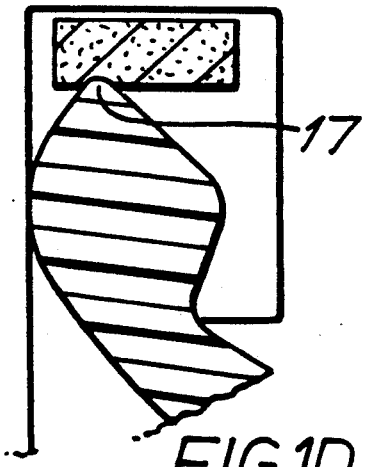
Figure 1E:
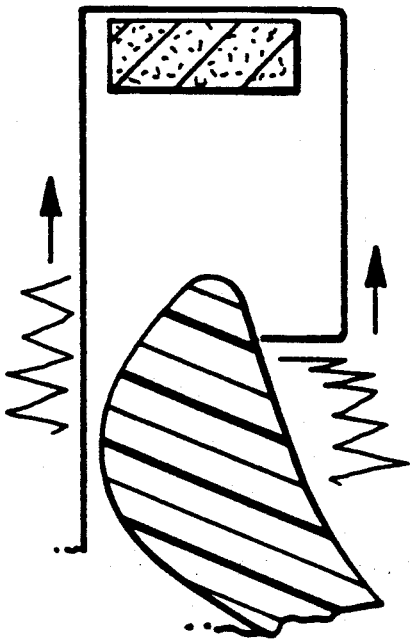

In FIGS. 1C–1E, the effect of extreme heat on a prior art dispenser is shown. The internal pressure bearing on the underside of the closure 6 increases, whilst the material from which the neck portion 4 and container 2 are made softens. The wall of the container bulges along the sloped region 16 identified in FIG. 1A and the neck portion 4 tilts as shown in FIGS. 1C and 1D. Although the sealing projection 15 moves away from the seal 12, other parts of the neck portion, for example the corner 17, remain in sealing contact with the seal 12 or with parts of the closure 6, such as the return 11. Eventually, the internal pressure is sufficiently high and the material of the neck region sufficiently soft for the closure to be released, in a potentially explosive manner (FIG. 1E). Until this happens, however, sealing is maintained between the neck portion 4 and the closure 6, so full pressure is maintained within the container 2.

The prior art dispenser 1 may be modified, in accordance with the present invention, to fail in a safe manner. This may be achieved by providing the neck region with at least one path around the neck portion within the closure, which path may be referred to as a passageway means, with an escape means which may take the form of a slot, groove or recess formed in the neck region. This escape means enables the pressure in the container to escape through the passageway means whilst the pressure in the container to escape through the passageway means whilst retaining the closure captive at the neck portion. Thus, aerosol dispensers in accordance with the present invention may have all of the features shown in FIG. 1 but will be modified in the neck portion 4 thereof as described below.

Figure 2A:
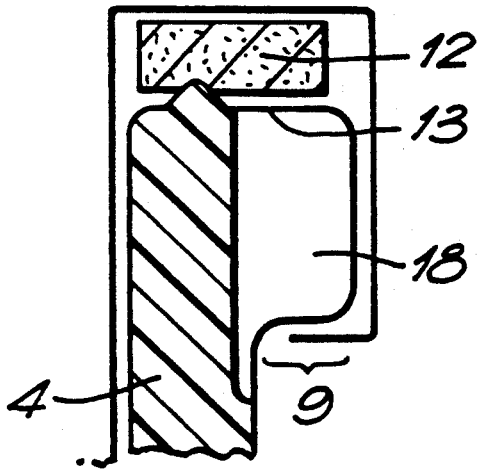
FIGS. 2A to 2D represent a first embodiment of an aerosol dispenser in accordance with the present invention.
Figure 2B:
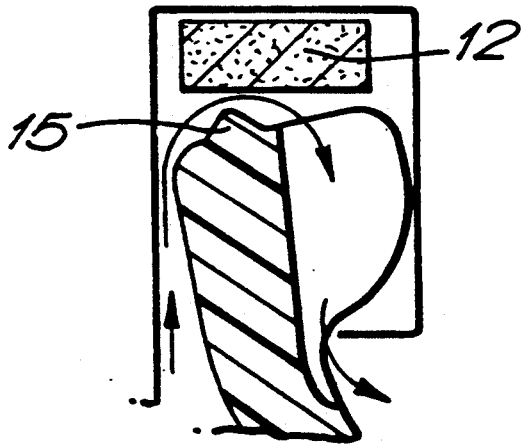
Figure 2C:
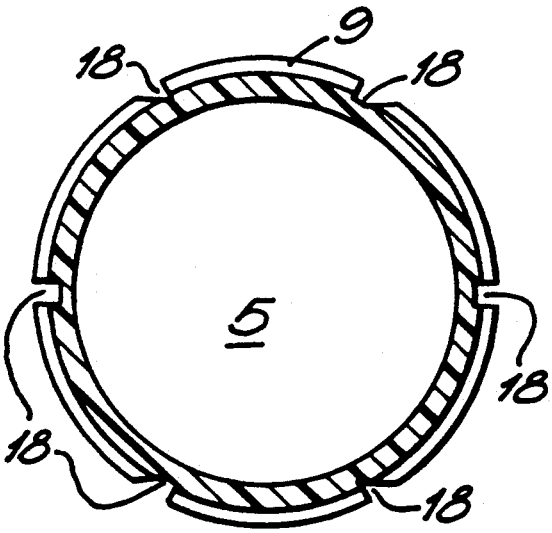
Figure 2D:
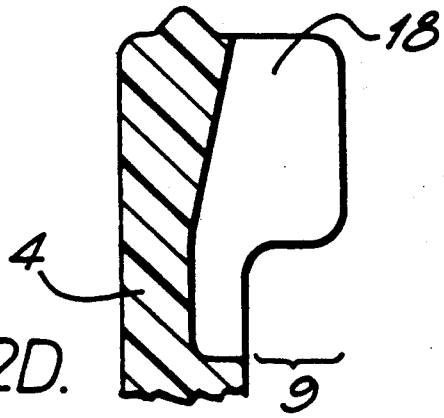

In a first embodiment of the present invention, the escape means comprises vertical slots provided in the outer periphery of the neck portion of the container. The slots act as passageways which enable fluid to escape from the container, so reducing the internal pressure, when the neck region begins to deform, without causing the closure to be forced off in an explosive manner. In FIGS. 2A and 2B, a cross-section through the neck portion of a dispenser in accordance with this embodiment is shown. FIG. 2C is a section through the neck portion 4 shown in FIG. 2A. In FIGS. 2A, and 2C, which show the neck portion 4 of a dispenser in normal use, the neck portion 4 is oriented in an upright fashion. The annular rim 9 is provided with vertical slots 18 which lead from the upper surface 13 of the neck portion 4 to the lower surface thereof. As shown, the slots extend not only through the width of the rim 9 but also into the continuation of the wall of the container. When more than one slot 18 are present they should be aligned in a parallel fashion (see FIG. 2C). This is because the containers are formed by blow-moulding preforms, which themselves are made by injection moulding. The shape of the neck portion is determined in the injection moulding process, and the slots 18 must be oriented to allow separation of the mould parts. For the same reason, the slots 18 may be flared toward the outside of the neck portion 4 to ease release of a container preform from the mould. As shown in FIG. 2B, when the neck portion softens and starts to follow the sequence shown in FIGS. 1C to 1D the seal between the rib 15 and the seal 12 is quickly released and the fluid can escape along the slots 18 from the container. FIG. 2D shows a modified neck portion cross-section, the groove 18 of which extends into the continuation of the wall by an amount greater than that for the neck portion shown in FIG. 2A. This is to ensure that the flow cross-section of the groove 18 is sufficiently large to allow rapid venting of the container.

Figure 3A:
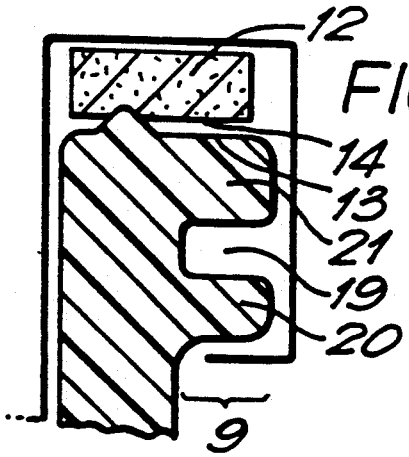
FIGS. 3A and 3B represent a second embodiment of an aerosol dispenser in accordance with the present invention.
Figure 3B:
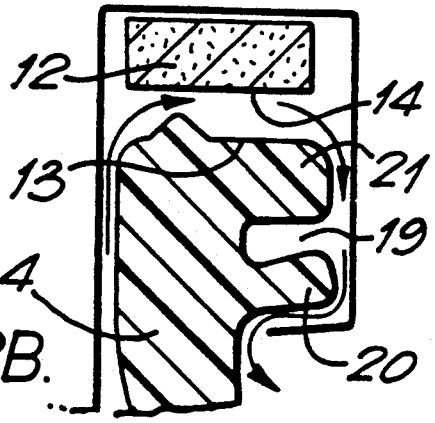

In a second embodiment of this invention, to form the escape means the neck portion may be provided, in its outer periphery with a generally horizontal circumferential groove. This groove should preferably extend across the width of the rim but not into the continuation of the container wall. The groove may be around part or all of the circumference of the neck portion. For example, as shown in FIGS. 3A and 3B, the neck portion 4 includes a circumferential groove 19 which extends around the rim 9 to delineate a lower rim region 20 and an upper rim region 21. On softening at elevated temperatures, the lower rim 20 region will initially move toward the upper rim region 21, occupying space previously taken by the groove 19. This enables the lower surface 14 of the seal 12 and the upper surface 13 of the neck portion 4 to move apart releasing the fluid tight seal and enabling fluid to escape from the container 2 in a controlled manner.

In the embodiment shown, the crystallinity in the upper rim region 21 may be raised by pre-treatment with heat. This raises the softening temperature of the upper rim region 21 relative to that of the lower rim region 20 and avoids the problem of the upper rim region 21 softening and blocking the passageway before release of the container pressure.

Figure 4A:
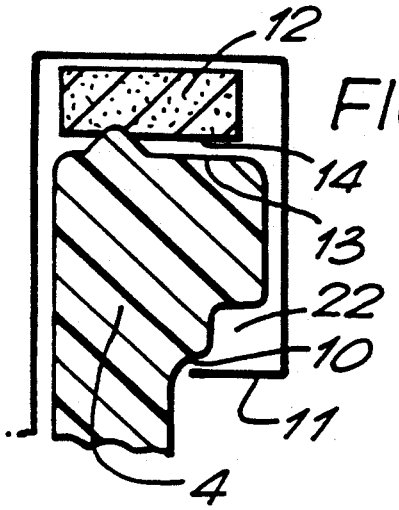
FIGS. 4A and 4B represent a third embodiment of an aerosol dispenser in accordance with the present invention.

In a third embodiment of this invention, to form the escape means the neck region may be provided with a recess along a portion of the lower edge of the rim. As shown in FIG. 4A, a recess 22 is provided in the lower edge of the rim. This has the effect of reducing the surface area over which the return 11 bears against the shoulder 10, making the shoulder 10 more susceptible to deformation. When such deformation occurs, upon softening of the neck material 4, the closure 6 moves upwards relative to the neck portion 4. This causes the upper surface 13 of the neck 4 and the lower surface 14 of the seal 12 to move apart permitting the release of pressure in the container.

Figure 5A:
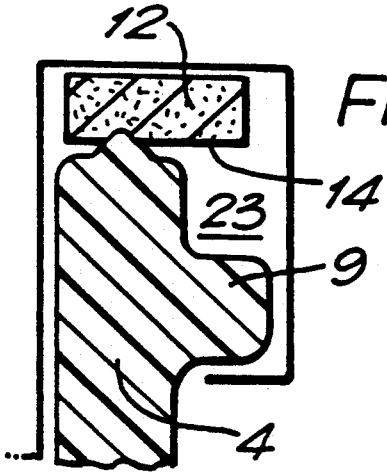
FIGS. 5A and 5B represent a fourth embodiment of an aerosol dispenser in accordance with the present invention.
Figure 5B:
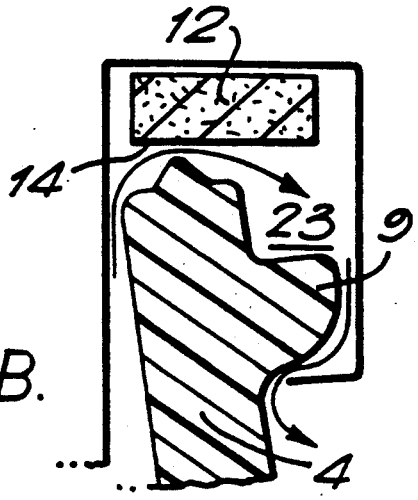

Finally, in a fourth embodiment of this invention, to form the escape means the neck portion may be provided with a recess along a portion of the upper surface of the projecting rim. An example of this configuration is shown in FIGS. 5A and 5B. The neck portion 4 is provided with a recess 23 in the upper surface of the projecting rim 9. As the neck portion 4 tilts on softening, the seal is broken between the seal 12 and neck 4. Unlike the sequence shown in FIGS. 1C to 1E, the seal cannot be maintained by a corner of the neck, because of the recess 23. The pressure in the container is, therefore, released in a controlled manner.

Figure 4B:
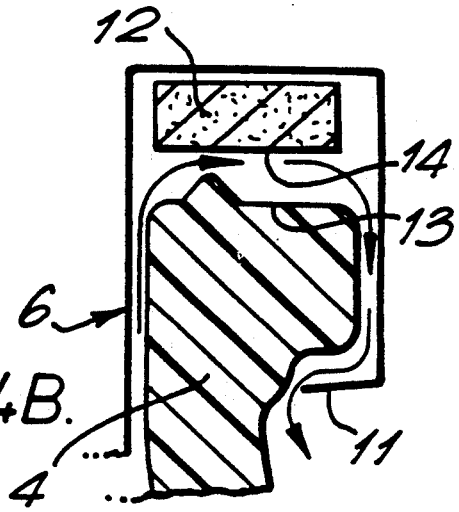

The embodiments shown in FIGS. 3 to 5 may be enhanced in performance by the provision of vertical grooves which cooperate with the horizontal groove (FIG. 3) or with the recesses (FIGS. 4 and 5). In other words, the features shown in FIGS. 3 to 5 may be used in conjunction with the feature of FIG. 2.

The container of this invention is preferably made from polyethyleneterephthalate (PET). Optionally, to increase the failure temperature the PET in the neck may be raised in crystallinity by pretreatment with heat. Alternatively an insert, made from a more heat resistant plastics material than PET, such as polycarbonate or polyarylate, may be provided at the neck region of the container. The insert may be a separate part which is fitted to the moulded preform, or the container preform may be injection moulded around the insert. As a yet further alternative, the container may be formed by coinjecting PET with the more heat resistant material, putting the heat resistant material preferentially in the neck/rim region. Further improvements may be achieved by crystalising the upper part of the rim only, leaving the lower part to crumple first.

We claim:

1. A dispenser comprising a plastics container and a closure which is secured in a fluid tight manner to a neck portion of the container, the neck portion of the plastics container and the closure forming between them a passageway means which is normally sealed by a seal means formed between an axial end of the neck portion and a seal portion of the closure which faces said axial end of the neck portion, said neck portion and closure further comprising an escape means which causes opening of the normally sealed passageway means upon deformation of the neck portion, by internal pressure at an elevated temperature, to permit release of the pressure within the dispenser by movement of the neck portion axially away from the said seal portion of the closure, while retaining the closure captive on the neck portion.

2. A dispenser according to claim 1, wherein the escape means includes at least one recess which enables the pressure in the container to escape whilst retaining the closure captive at the neck portion.

3. A dispenser according to claim 2, wherein the recess comprises vertical slots in the outer periphery of the neck portion of the container.

4. A dispenser according to claim 2, wherein the recess comprises slots which extend into the wall of the container adjacent the neck portion.

5. A dispenser according to claim 1, wherein the escape means comprises a generally circumferentially disposed groove provided in the outer periphery of the neck portion.

6. A dispenser according to claim 5, wherein said groove extends around at least part of the circumference of the neck portion.

7. A dispenser according to claim 1, wherein the escape means comprises a recess formed along a lower portion of the neck portion.

8. A dispenser according to claim 1, wherein the upper region of the neck portion which has a crystallinity which is raised relative to the crystallinity of the remainder of the plastic container.

9. A dispenser according to claim 8, wherein the crystallinity in the upper region of the neck portion is raised by pre-treatment with heat.

* * * * *